United States Patent [19]

Harrison et al.

[11] Patent Number: 4,734,396

[45] Date of Patent: Mar. 29, 1988

[54] COMPRESSION LAYER FOR DYE-RECEIVING ELEMENT USED IN THERMAL DYE TRANSFER

[75] Inventors: Daniel J. Harrison, Rochester; Kin K. Lum, Webster; Noel R. Vanier, Rochester, all of N.Y.

[73] Assignee: Eastman Kodak Company, Rochester, N.Y.

[21] Appl. No.: 916,927

[22] Filed: Oct. 8, 1986

[51] Int. Cl.[4] ..... B41M 5/26

[52] U.S. Cl. ..... 503/227; 8/471; 428/195; 428/480; 428/483; 428/500; 428/522; 428/523; 428/913; 428/914; 430/945

[58] Field of Search ..... 8/470, 471; 428/195, 428/207, 913, 914, 480, 483, 500, 522, 523; 430/945; 503/227

[56] References Cited

FOREIGN PATENT DOCUMENTS 60-236794 6/1985 Japan ..... 8/471

*Primary Examiner*—Bruce H. Hess

*Attorney, Agent, or Firm*—Harole E. Cole

[57] ABSTRACT

A dye-receiving element for thermal dye transfer process and assemblage comprises a compression layer between the support and the dye image-receiving layer which has a greater compressibility than either the support or the receiving layer and being coated at a coverage of at least 2.0 g/m$^2$. In a preferred embodiment, the compression layer has a compression modulus of less than 350 mega Pascals. Use of the compression layer minimizes image defects.

20 Claims, No Drawings

COMPRESSION LAYER FOR DYE-RECEIVING ELEMENT USED IN THERMAL DYE TRANSFER

This invention relates to dye-receiving elements used in thermal dye transfer, and more particularly to the use of a compression layer between the support and the dye image-receiving layer, in order to minimize image defects.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

In Japanese laid open publication number 60/236,794, an image-receiving element for thermal dye transfer printing is disclosed. The dye image-receiving layer is coated on top of a thermoplastic polymer layer such as poly(ethylene terephthalate) which is coated on the support. The polymer layer is said to help prevent the production of irregular images caused by the nonuniformity of the thickness of the image-receiving layer.

There is a problem with the above laminate in that it does not always lessen defects caused by other sources such as entrapped dust and irregularities in the thermal head, printing platten, dye-donor element and dye-receiving element. These defects generally show up as non-printed (i.e., minimum density) spots and areas, and thus are very visible against higher density backgrounds.

It would be desirable to provide a way to lessen defects in a thermal print element.

In accordance with this invention, a dye-receiving element for thermal dye transfer is provided which comprises a support having thereon, in order, a compression layer and a dye image-receiving layer, the compression layer having a compressibility greater than that of the support or the dye image-receiving layer and being coated at a coverage of at least 2.0 g/m$^2$. Use of this layer of the invention promotes better printing contact between the dye-donor and dye image-receiving element, thus reducing the number of defects.

In a preferred embodiment of the invention, the compression layer has a compression modulus of less than 350 mega Pascals ($10^6$ Pascals) (MPa).

The following list of preferred polymeric materials have a compression modulus of less than 350 MPa:

Compound 1—poly(methylmethacrylate)

Compound 2—poly(styrene-co-acrylonitrile) (70:30 weight ratio)

Compound 3—poly(butylene terephthalate) modified with 30 mol % glutaric acid and 45 mol % diethylene glycol Compound 4—a lightly branched ether modified poly(-cyclohexylene-cyclohexane-dicarboxylate):

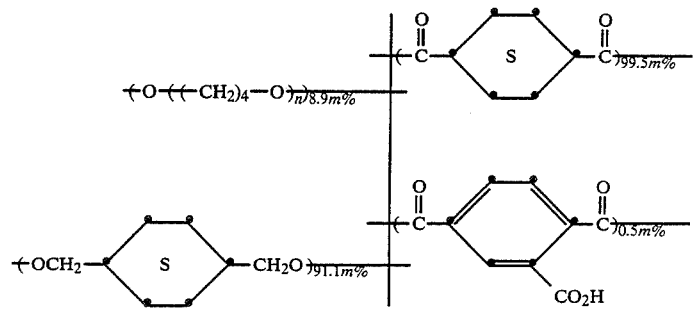

n~13

Compound 5—poly(butylene terephthalate) modified with 50 mol % isophthalic acid and 15 mol % sebacic acid, Bostik 7962 ®, Bostik Div., USMCorp.

Compound 6—poly(ethylene-co-vinyl acetate), Elvax 40 ®, duPont Corp.

Compound 7—low or medium density poly(ethylene)

Compound 8—poly(butadiene)

Compound 9—poly(isoprene)

Compound 10—poly(butyl acrylate)

Compound 11—poly(styrene) foam

Compound 12—poly(caprolactone)

The support for the dye-receiving element of the invention may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek ®. In a preferred embodiment, polyester with a white pigment incorporated therein is employed.

The dye image-receiving layer may comprise, for example, a polycarbonate, a polyester or mixtures thereof. The dye image-receiving layer may be present in any amount which is effective for the intended purpose. In general, good results have been obtained at a concentration of from about 1 to about 5 g/m$^2$.

A dye-donor element that is used with the dye-receiving element of the invention comprises a support having thereon a dye layer. Any dye can be used in such a layer provided it is transferable to the dye image-receiving layer of the dye-receiving element of the invention by the action of heat. Especially good results have been obtained with sublimable dyes. Examples of sublimable dyes include anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

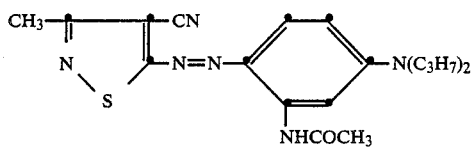

(magenta)

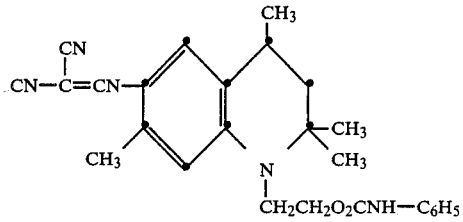

(yellow)

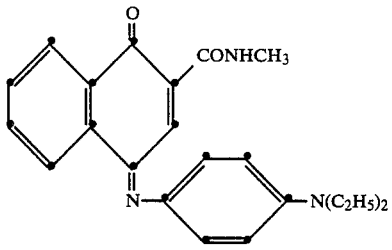

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether imides. The support generally has a thickness of from about 2 to about 30 μm. It may also be coated with a subbing layer, if desired.

A dye-barrier layer comprising a hydrophilic polymer may also be employed in the dye-donor element between its support and the dye layer which provides improved dye transfer densities.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

As noted above, dye-donor elements are used to form a dye transfer image. Such a process comprises imagewise-heating a dye-donor element and transferring a dye image to a dye-receiving element as described above to form the dye transfer image. An additional step of heating the dye-receiving element containing the transferred dye image will reduce stratification of the transferred image dye in the dye-receiving element. This can be done using a separate heated roller or heating apparatus, or the thermal print head itself can be used in the heating step as disclosed and claimed in copending U.S. application Ser. No. 879,690 filed June 27, 1986, by Vanier et al. entitled "Non-imagewise Reheating of Transferred Dyes in Thermal Dye Transfer Elements."

The dye-donor element employed in certain embodiments of the invention may be used in sheet form or in a continuous roll or ribbon. If a continuous roll or ribbon is employed, it may have only one dye thereon or may have alternating areas of different dyes, such as cyan, magenta, yellow, black, etc., as disclosed in U.S. Pat. No. 4,451,830.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements employed in the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises (a) a dye-donor element as described above, and
(b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

A magenta dye-donor element was prepared by coating the following layers in the order recited on a 6 μm poly(ethylene terephthalate) support:

(1) Dye barrier layer of poly(acrylic acid) (0.17 g/m$^2$) coated from a water-methanol solvent mixture; and
(2) Dye layer containing the following magenta dye (0.22 g/m$^2$) in a cellulose acetate hydrogen phthalate (32–36% phthalyl) (18–21% acetyl) binder (0.38 g/m$^2$) coated from an acetone, butanone and cyclohexanone solvent mixture:

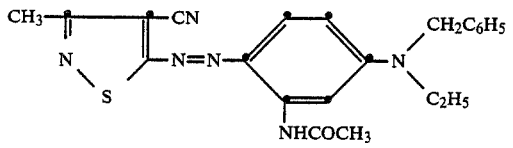

A slipping layer was coated on the back side of the element similar to that disclosed in U.S. application Ser. No. 813,199 of Vanier et al. filed Dec. 24, 1985.

Dye receiving elements according to the invention were prepared by coating on a poly(ethylene terephthalate) support containing titanium dioxide of 175 μm (7 mil) thickness:

(1) a compression layer as indicated in Table 1 from a dichloromethane and trichloroethylene solvent mixture, and
(2) a dye image-receiving layer of a solution of Bayer AG Makrolon 5705® Polycarbonate (2.9 g/m$^2$), 1,4-didecoxy-2,5-dimethoxybenzene (0.38 g/m$^2$) and FC-431® surfactant (3M Corp) (0.017 g/m$^2$) coated from a dichloromethane and trichloroethylene solvent mixture.

Additional dye-receiving elements were prepared according to the invention similar to those described above except that the dye image-receiving layer was hot-melt laminated onto the compression layer. This was accomplished by first coating the dye-image receiving layer onto an unsubbed poly(ethylene terephthalate) (7 mil) film support. The receiving layer side of this coating was then placed in contact with the compression layer coated on the white support. This composite was then laminated together with a pair of rubber rollers heated to about 150° C. After cooling, the unsubbed film support was peeled away from the composite leaving the receiving layer laminated to the compression layer.

A control receiving element, C1, was prepared by coating the above dye image-receiving layer directly on the white polyester support.

Another control receiving element, C2, was prepared by coating an interlayer of a "rigid" (i.e., relatively non-compressible) polymer of Lexan 131® bisphenol-A-polycarbonate, General Electric Corp., at 5.4 g/m$^2$ on top of the white polyester support. This was then coated with the dye image-receiving layer 2 above.

Another control receiving element, C3, was the white polyester support only.

Dirt Test

Because casual dirt, as encountered in various indoor environments cannot be easily reproduced, a "dirt" test had to be devised. This basically consisted of introducing a fixed level of material simulating dirt onto the surface of a dye-donor, thermally printing the donor onto the receiver, and then visually counting the number of defects observed above a given size on the dye-receiver surface. The material chosen to simulate dirt was Teflon® beads.

A Paasche Airbrush® (with H5 and HC5 color and air parts) was used to spray duPont Teflon 35® Resin Fluorocarbon Dispersion (a 32% solids solution of 0.05 to 0.5 μm diameter Teflon® particles). The dye side of the dye-donor was sprayed until a visually uniform "stipple" effect was produced. The treated donor was then allowed to air dry for a few minutes.

The dye side of the treated dye-donor element strip 4.5 inches (114 mm) wide was then placed in contact with the dye image-receiving layer of the dye-receiver element of the same width. The assemblage was fastened in the jaws of a stepper motor driven pulling device. The assemblage was laid on top of a 0.55 in. (14 mm) diameter hard rubber roller and a Kyocera Thermal Head, Type KMT-85-6NPDI, was pressed with weights at a force of 9.0 pounds (4.0 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were pulse-heated at increments from 0 to 8.3 msec to generate a mid-scale uniform density test image approximately 8 cm×10 cm (of 512 pixels in 512 lines). The voltage supplied to the print head was approximately 22 v representing approximately 1.5 watts/dot (12 mjoules/dot) for maximum power.

Each dye-receiver was separated from each dye donor and the the latter was examined for surface defects or "dirt". The number of low density (or non-printed) spots equal or greater in size than 0.2 mm diameter within a 1 cm by 1 cm area were determined. This process was repeated for another two areas on each dye donor to obtain an "average spots/cm$^2$" (s/cm$^2$).

Compressibility Test

A compressibility test involving surface deformation with a tool steel pin was also run. Each compression layer or control interlayer was compression molded or solvent cast and dried as a separate film, 75 μm to 100 μm thick. The compression modulus in mega Pascals was determined using an Instron ® Model 1133 Tensile Testing Machine with a compression cage and tool-steel pin 0.3275 cm long and 0.05 cm diameter normal to the film. The speed of compression was 0.1 cm/min and the compressive strain was 5–15%.

The following results were obtained:

TABLE 1

| Compression Layer (g/m$^2$) | Compressibility (MPa) | Spots/cm$^2$ |
|---|---|---|
| None - receiving layer only - C1 (0) | 450 | 92 |
| Polycarbonate interlayer - C2 (5.4) | 380 | 82 |
| None - support only - C3 (0) | 500 | ** |
| Compound 1 (5.4) | 330 | 44 |
| Compound 2 (5.4) | 300 | 36 |
| Compound 3 (71) | 130 | 18 |
| Compound 4* (11) | 110 | 24 |
| Compound 4* (8) | 110 | 24 |
| Compound 4* (5.4) | 110 | 28 |
| Compound 4* (2.2) | 110 | 43 |
| Compound 4* (1.1) | 110 | 91 |
| Compound 5 (75) | 85 | 26 |
| Compound 6 (11) | 15 | 18 |

*The dye image-receiving layer was solution coated for this element. All others were hot-melt laminated.
**Since there was no receiving layer, no image was transferred.

The above data show that compression layers according to the invention which have a compressibility of less than approximately 350 MPa and coated at more than 2 g/m$^2$, were effective in minimizing defects due to casual "dirt".

EXAMPLE 2

Polyethylene Compression Layers

A dye donor element was prepared as in Example 1.

Dye receiving elements according to the invention were prepared by coating on a poly(ethylene terephthalate) support 175 μm (7 mil) thickness containing titanium dioxide:

(1) a subbing layer of poly(acrylonitrile-co-vinylidene chloride-co-acrylic acid) (14/80/6 wt. ratio) (0.22 g/m$^2$) from a butanone and cyclopentanone solvent mixture;

(2) a compression layer of a medium-density poly(ethylene) (MDPE) or a low-density poly(ethylene) (LDPE) containing 17.5% by weight rutile titanium dioxide, coated by extrusion, and (3) a dye image-receiving layer of a solution of Bayer AG Makrolon 5705 ® Polycarbonate (2.9 g/m$^2$), 1,4-didecoxy-2,5-dimethoxybenzene (0.38 g/m$^2$) and FC-431 ® surfactant (3M Corp) (0.022 g/m$^2$) coated from a dichloromethane and trichloroethylene solvent mixture.

No separate control was prepared, but the control from Example 1 may be used for approximate comparison. A compressibility test and dirt test were run as described in Example 1. The following results were obtained:

TABLE 2

| Compression Layer (g/m$^2$) | Compressibility (MPa) | Average Spots/cm$^2$ |
|---|---|---|
| None - receiving layer only - C1 (0) | 450 | 92 |
| None - support only - C3 (0) | 500 | * |
| MDPE (28) | 150 | 24 |
| MDPE (23) | 150 | 24 |
| MDPE (15) | 150 | 27 |
| LDPE (15) | 95 | 26 |
| LDPE (28) | 95 | 24 |

*Since there was no receiving layer, no image was transferred.

The above data again show that compression layers according to the invention which have a compressibility of less than approximately 350 Mpa and coated at more than 2 g/m$^2$, were effective in minimizing defects due to casual "dirt".

EXAMPLE 3

Paper supports with poly(ethylene) compression layers

A dye donor element was prepared as in Example 1.

Dye-receiving elements according to the invention were prepared by coating the dye image-receiving layer of Example 2 on top of the following supports:

1. A commercially produced paper stock, of base 7 mil (175 μm thick), 190 g/m$^2$ mixture of hard woodcraft and soft wood-sulfite bleached pulp overcoated with two MDPE's of total laydown 32 g/m$^2$ with approximately 12% by weight anatase titanium dioxide and 3% zinc oxide (layer thickness approximately 25 μm).
2. A commercially produced overcoated paper stock similar to (1) but using 151 g/m$^2$ base and overcoated with LDPE (12.2 g/m$^2$) with approximately 10% by weight rutile titanium dioxide.

A control was run using the support only from (1) above without the compression layer and the control from Example 1 was also used for approximate comparison. A compressibility test and dirt test were run as described in Example 1. The following results were obtained:

TABLE 3

| Compression Layer (g/m$^2$) | Compressibility (MPa) | Average Spots/cm$^2$ |
|---|---|---|
| None - receiving layer only - C1 (0) | 450 | 92 |
| None - support only (0) | 460 | * |
| MDPE (32) | 80 | 25 |
| LDPE (12) | 63 | 31 |

*Since there was no receiving layer, no image was transferred.

The above data again show that compression layers according to the invention which have a compressibility of less than approximately 350 MPa and coated at more than 2 g/m$^2$, were effective in minimizing defects due to casual "dirt".

The invention has been described in detail with particular reference to preferred embodiments thereof, but it will be understood that variations and modifications can be effected within the spirit and scope of the invention.

What is claimed is:

1. A dye image-receiving element for thermal dye transfer comprising a plastic film support having thereon, in order, a compression layer and a dye image-receiving layer, said compression layer having a compressibility greater than that of the support or the dye image-receiving layer and being coated at a coverage of at least 2.0 g/m$^2$.

2. The element of claim 1 wherein said compression layer has a compression modulus of less than 350 mega Pascals.

3. The element of claim 1 wherein said compression layer is poly(methylmethacrylate).

4. The element of claim 1 wherein said compression layer is poly(styrene-co-acrylonitrile).

5. The element of claim 1 wherein said compression layer is poly(butylene terephthalate) modified with 30 mol % glutaric acid and 45 mol % diethylene glycol.

6. The element of claim 1 wherein said compression layer is the lightly branched ether modified poly(cyclohexylene-cyclohexanedicarboxylate):

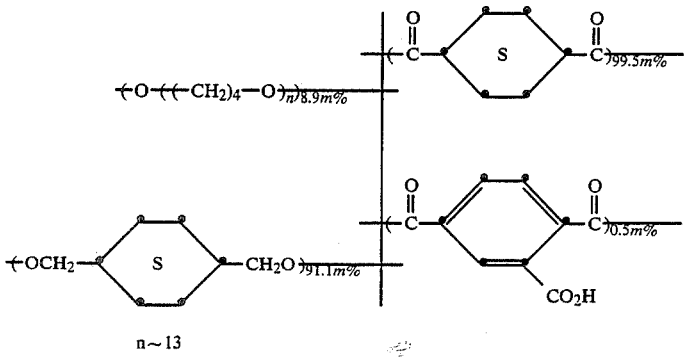

7. The element of claim 1 wherein said compression layer is poly(butylene terephthalate) modified with 50 mol % isophthalic acid and 15 mol % sebacic acid.

8. The element of claim 1 wherein said compression layer is poly(ethylene-co-vinyl acetate).

9. The element of claim 1 wherein said compression layer is poly(ethylene).

10. In a process of forming a dye transfer image comprising imagewise-heating a dye-donor element and transferring a dye image to a dye-receiving element to form said dye transfer image, said dye-receiving element comprising a support having thereon a dye image-receiving layer, the improvement wherein a compression layer is located between said support and said dye image-receiving layer, said compression layer having a compressibility greater than that of said plastic film support or said dye image-receiving layer and being coated at a coverage of at least 2.0 g/m$^2$.

11. The process of claim 10 wherein said compression layer has a compression modulus of less than 350 mega Pascals.

12. The process of claim 10 wherein the support for the dye-donor element comprises poly(ethylene terephthalate) which is coated with sequential repeating areas of cyan, magenta and yelllow dye, and said process steps are sequentially performed for each color to obtain a three-color dye transfer image.

13. In a thermal dye transfer assemblage comprising:

(a) a dye-donor element comprising a plastic film support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer, the improvement wherein a compression layer is located between said support of said dye-receiving element and said dye image-receiving layer, said compression layer having a compressibility greater than that of said support or said dye image-receiving layer and being coated at a coverage of at least 2.0 g/m$^2$.

14. The assemblage of claim 13 wherein said compression layer has a compression modulus of less than 350 mega Pascals.

15. The assemblage of claim 13 wherein said compression layer is poly(methylmethacrylate).

16. The assemblage of claim 13 wherein said compression layer is poly(styrene-co-acrylonitrile).

17. The assemblage of claim 13 wherein said compression layer is poly(butylene terephthalate) modified with 30 mol % glutaric acid and 45 mol % diethylene glycol.

18. The assemblage of claim 13 wherein said compression layer is the lightly branched ether modified poly(cyclohexylene-cyclohexanedicarboxylate):

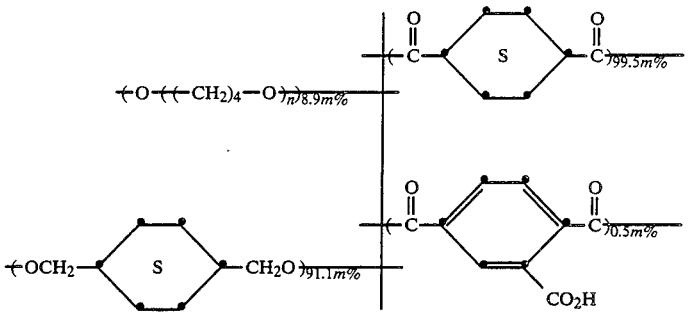
n~13
19. The assemblage of claim 13 wherein said compression layer is poly(butylene terephthalate) modified with 50 mol % isophthalic acid and 15 mol % sebacic acid.
20. The assemblage of claim 13 wherein said compression layer is poly(ethylene-co-vinyl acetate) or poly(ethylene).
* * * * *

UNITED STATES PATENT OFFICE

CERTIFICATE OF CORRECTION

PATENT NO. : 4,734,396
DATED : March 29, 1988
INVENTOR(S) : Daniel J. Harrison, Kin K. Lum and Noel R. Vanier It is certified that error appears in the above-identified patent and that said Letters Patent are hereby corrected as shown below:

Column 9, line 64, before "support" insert ---plastic film---; line 68, delete "plastic film".

Column 10, line 9, "yelllow" should read ---yellow---; line 13, delete "plastic film"; line 15, before "support" insert ---plastic film---.

Signed and Sealed this

Thirtieth Day of August, 1988

*Attest:*

DONALD J. QUIGG

*Attesting Officer*

*Commissioner of Patents and Trademarks*